US008837965B2

(12) United States Patent
Tanaka

(10) Patent No.: US 8,837,965 B2
(45) Date of Patent: Sep. 16, 2014

(54) IMAGE FORMING APPARATUS AND CONTROL METHOD THEREOF

(75) Inventor: Sumito Tanaka, Tokyo (JP)

(73) Assignee: Canon Kabushiki Kaisha (JP)

( * ) Notice: Subject to any disclaimer, the term of this patent is extended or adjusted under 35 U.S.C. 154(b) by 174 days.

(21) Appl. No.: 13/638,023

(22) PCT Filed: Mar. 16, 2011

(86) PCT No.: PCT/JP2011/057059

§ 371 (c)(1),
(2), (4) Date: Sep. 28, 2012

(87) PCT Pub. No.: WO2011/125503

PCT Pub. Date: Oct. 13, 2011

(65) Prior Publication Data

US 2013/0016988 A1 Jan. 17, 2013

(30) Foreign Application Priority Data

Apr. 9, 2010 (JP) ..... 2010-090917

(51) Int. Cl.
*G03G 15/00* (2006.01)

(52) U.S. Cl.
CPC .. *G03G 15/5037* (2013.01); *G03G 2215/00054* (2013.01); *G03G 15/5041* (2013.01); *G03G 2215/00042* (2013.01)
USPC ..... 399/49; 399/50

(58) Field of Classification Search
CPC ..... G03G 15/5037; G03G 15/5041; G03G 15/04009
USPC ..... 399/49, 50, 55
See application file for complete search history.

(56) References Cited

U.S. PATENT DOCUMENTS

| | | | |
|---|---|---|---|
| 5,652,947 | A | 7/1997 | Izumizaki |
| 6,122,075 | A | 9/2000 | Yamada et al. |
| 2006/0120741 | A1 | 6/2006 | Murakami et al. |
| 2007/0237532 | A1 | 10/2007 | Fujiwara |
| 2010/0067932 | A1 | 3/2010 | Fujiwara |

FOREIGN PATENT DOCUMENTS

| | | | |
|---|---|---|---|
| JP | 05-323791 | A | 12/1993 |
| JP | 10-133437 | A | 5/1998 |
| JP | 2006-145903 | A | 6/2006 |
| JP | 2007-298949 | A | 11/2007 |
| JP | 2008-129321 | A | 6/2008 |
| JP | 2010-066697 | A | 3/2010 |

OTHER PUBLICATIONS

International Search Report issued Jun. 14, 2011 for parent PCT Application No. PCT/JP2011/057059.

*Primary Examiner* — Walter L Lindsay, Jr.
*Assistant Examiner* — Barnabas Fekete
(74) *Attorney, Agent, or Firm* — Rossi, Kimms & McDowell, LLP

(57) ABSTRACT

An image forming apparatus and a control method thereof are provided that determine a final contrast potential taking into consideration not only the relationship between the contrast potential of an electrostatic latent image and the density value of a developed image but also a toner charge amount for developing the electrostatic latent image. To accomplish this, the image forming apparatus of the present invention predicts, in advance, the contrast potential of the electrostatic latent image and the density of the toner image at the contrast potential for a predetermined toner charge amount. Furthermore, the image forming apparatus forms an image by adjusting the relationship between the contrast potential and density measured in advance based on a current toner charge amount and a saturation toner charge amount when forming the image.

6 Claims, 13 Drawing Sheets

IMAGE FORMING APPARATUS AND CONTROL METHOD THEREOF

This application is a U.S. National Phase Application of PCT International Application PCT/JP2011/057059 filed on Mar. 16, 2011 which is based on and claims priority from JP 2010-090917 filed on Apr. 9, 2010 the contents of which is incorporated in its entirety by reference.

TECHNICAL FIELD

The present invention relates to an image forming apparatus that employs electrophotography, such as a copying machine or a printer, and a control method thereof.

BACKGROUND ART

Electrophotographic image forming apparatuses are provided with a charging device that uniformly charges the photosensitive surface of an image carrier (for example, a photosensitive drum), a latent image forming device that forms an electrostatic latent image on the charged photosensitive surface according to image information, and a developing device that develops the electrostatic latent image. Furthermore, the image forming apparatuses are also provided with a transfer device that transfers the electrostatic latent image developed with a developer onto recording paper, and successively performs an image forming process while rotating the photosensitive surface of the photosensitive drum. With such image forming apparatuses, variations occur in image density and gray scale reproduction properties due to the influence of short-term variations resulting from a variation in the installation environment of the apparatus and a variation in the internal environment of the apparatus, and long-term variations resulting from changes over time (degradation over time) of the photosensitive drum and the developer. In other words, in order to output images of uniform density and gray scale reproduction properties, corrections need to be made as appropriate taking such variations into consideration.

To address the problems described above, Japanese Patent Laid-Open No. 2007-298949 proposes an image forming apparatus that controls the amount of light and the duration of light emission in consideration of the spot size of a laser. With this configuration, it is possible to obtain a relationship between development contrast and a plurality of density patches truly representing the development characteristics of the image forming apparatus in a short time without changing a charging bias and a developing bias. Accordingly, with Japanese Patent Laid-Open No. 2007-298949, appropriate values for the charging bias and the developing bias can be obtained from the obtained relationship, so that control of dense areas can be performed with high accuracy.

However, the technique described above has the following problems. For example, with the technique disclosed in Japanese Patent Laid-Open No. 2007-298949, if a toner charge amount is lower than a desired level when obtaining appropriate setting values for the charging bias and the developing bias from the relationship between density patch and development contrast, images are formed with a density higher than a predetermined level. For this reason, a control device controls contrast so as to suppress the amount of toner developed. When the toner charge amount is not at a desired level, if the user starts printing after density stabilization control has been performed in which appropriate setting values for the charging bias and the developing bias have been obtained, the toner charge amount changes due to friction between the toner and the carrier. When the toner consumption amount is low, the toner charge amount increases, and the density decreases accordingly. Consequently, appropriate setting values for the charging bias and the developing bias cannot be obtained with a desired charge amount. As described above, with the method in which the contrast potential is set based on the toner density, it may not be possible to output images at a desired density due to a change in the toner charge amount.

SUMMARY OF INVENTION

The present invention enables realization of an image forming apparatus and a control method thereof that determine a final contrast potential taking into consideration not only the relationship between the contrast potential of an electrostatic latent image and the density value of an developed image, but also the toner charge amount for developing the electrostatic latent image.

One aspect of the present invention provides an image forming apparatus comprising a charging means for charging an image carrier, an exposure means for exposing the charged image carrier to light to form an electrostatic latent image, and a development means for developing the electrostatic latent image using toner, the image forming apparatus further comprising: a detecting means for detecting a contrast potential of the electrostatic latent image and a density of the toner image developed by the development means; and a determining means for determining a final contrast potential for image formation, using a relationship between the contrast potential of the electrostatic latent image and the density of the toner image detected by the detecting means, and a ratio between a saturation toner charge amount that is an amount of charge of toner converged to a given value and a current toner charge amount that is a current amount of charge of toner for image formation.

Another aspect of the present invention provides a method for controlling an image forming apparatus including a charging means for charging an image carrier, an exposure means for exposing the charged image carrier to light to form an electrostatic latent image, and a development means for developing the electrostatic latent image using toner, the method comprising: detecting, by a detecting means, a contrast potential of the electrostatic latent image and a density of the toner image developed by the development means; and determining, by a determining means, a final contrast potential for image formation, using a relationship between the contrast potential of the electrostatic latent image and the density of the toner image detected in the detecting step, and a ratio between a saturation toner charge amount that is an amount of charge of toner converged to a given value and a current toner charge amount that is a current amount of charge of toner for image formation.

Further features of the present invention will be apparent from the following description of exemplary embodiments with reference to the attached drawings.

DESCRIPTION OF EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Configuration of Image Forming Apparatus

Figure 2:
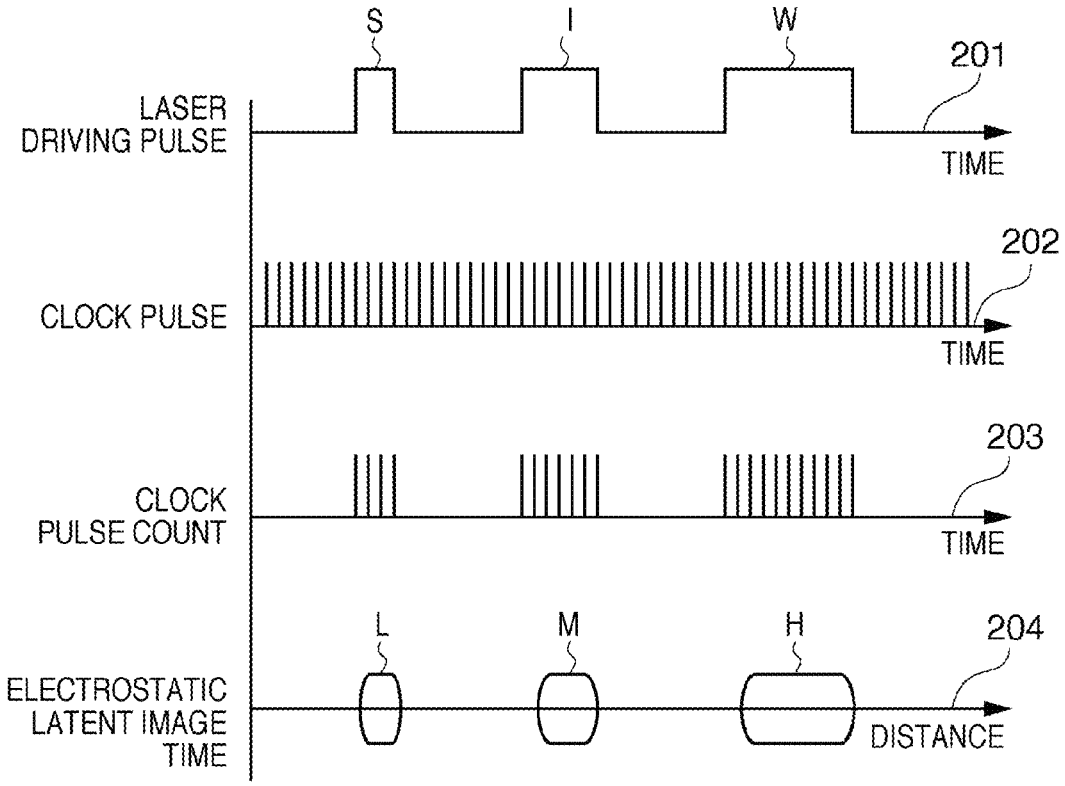
FIG. 2 is a diagram showing the relationship between a laser driving pulse driving a semiconductor laser according to the first embodiment and an electrostatic latent image formed on a photosensitive drum.
Figure 3:
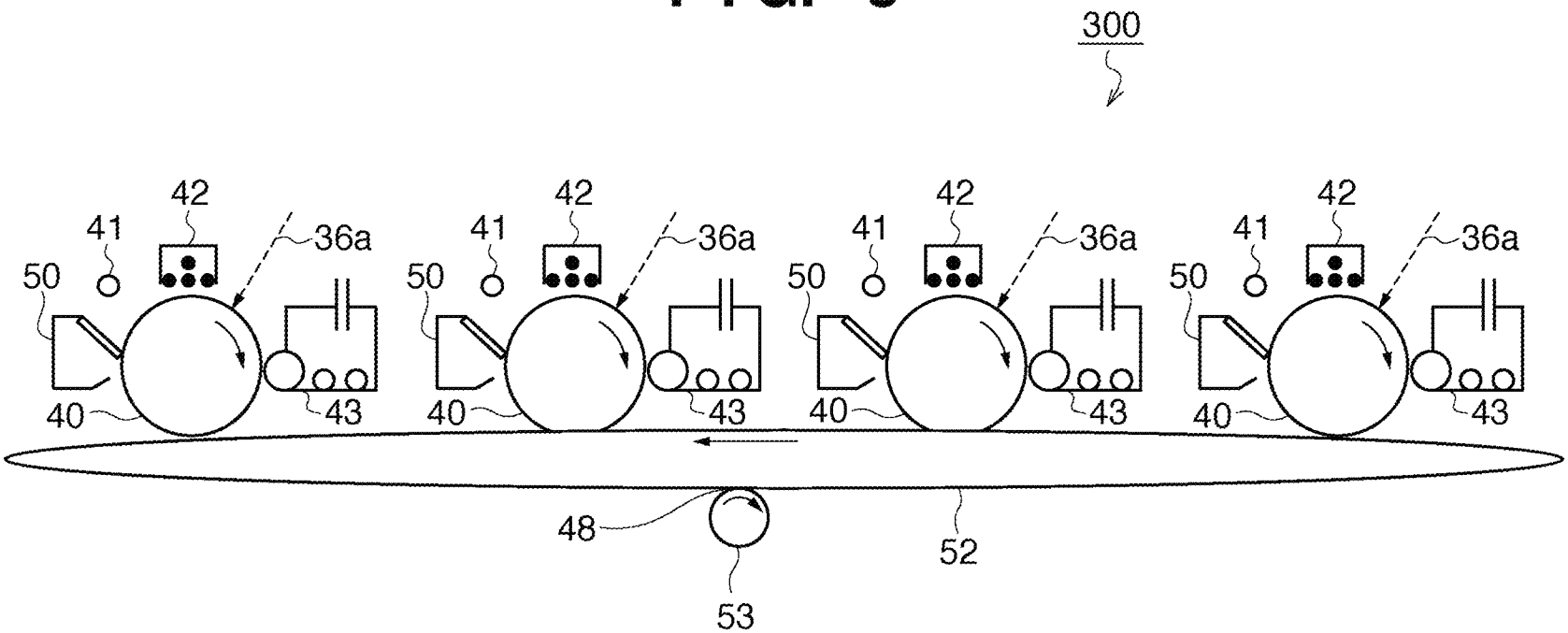
FIG. 3 is a cross-sectional view of an image forming apparatus 300 according to a variation of the first embodiment.

Hereinafter, a first embodiment will be described with reference to FIGS. 1 to 14. The present embodiment will be described using an example in which the present invention is applied to a copying machine having one photosensitive drum, but the application of the present invention is not limited to the copying machine having one photosensitive drum. The present invention is also applicable to, for example, an image forming apparatus as shown in FIG. 3 in which Y, M, C and Bk image forming units are arranged along the direction in which recording sheets are conveyed. An example of the configuration of an image forming apparatus 100 according to the present embodiment will be described first with reference to FIG. 1.

Figure 1:
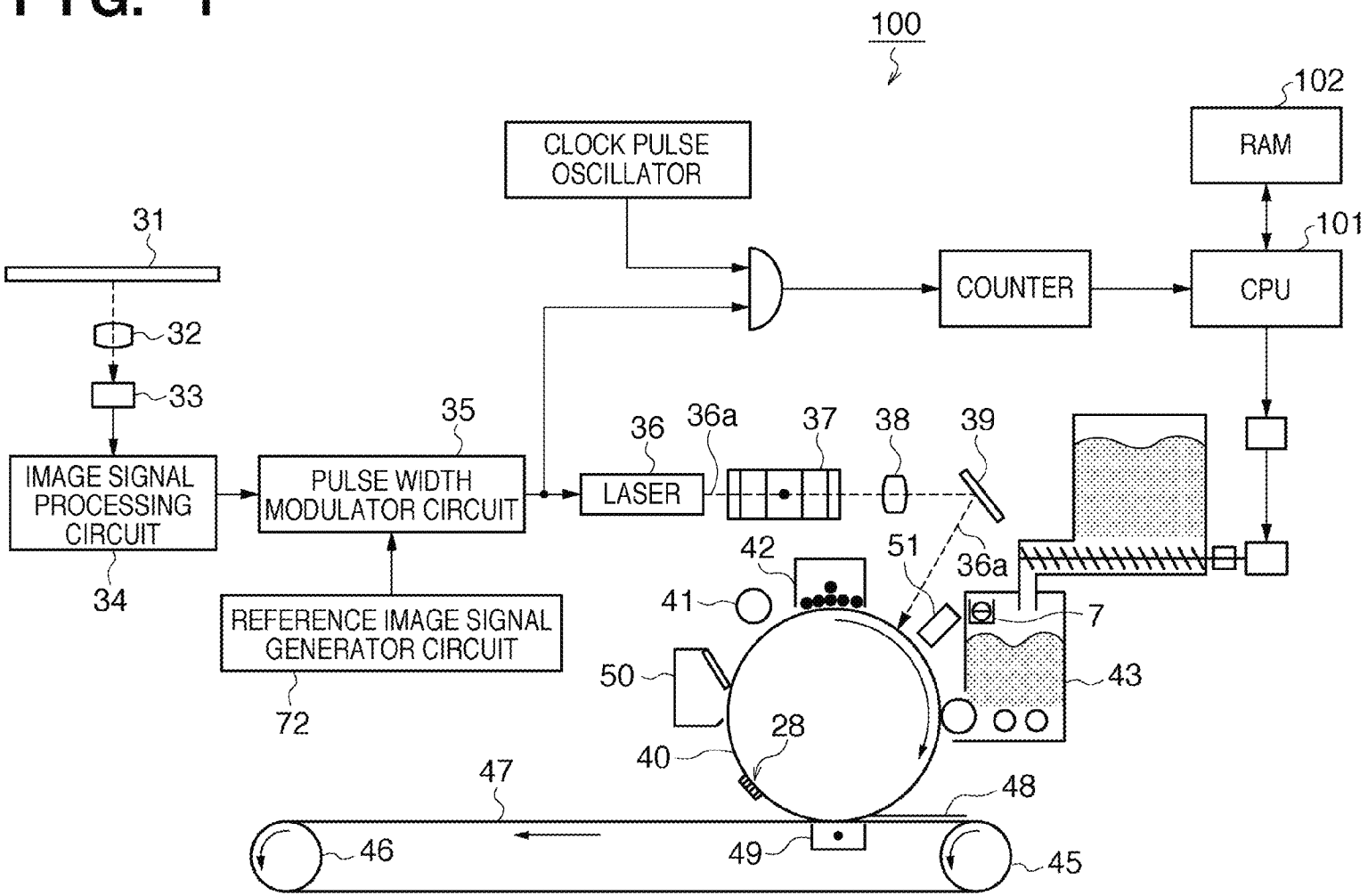
FIG. 1 is a cross-sectional view showing an example of a configuration of an image forming apparatus 100 according to a first embodiment.

An image of a document 31 to be copied by the image forming apparatus 100 shown in FIG. 1 is projected as an optical image onto an image sensor 33 such as a CCD via a lens 32. The image sensor 33 resolves the image of the document 31 into pixels of 600 dpi (one pixel unit) and generates an electric signal by photoelectric conversion corresponding to the density of each pixel. The photoelectric conversion signal (analog image signal) output from the image sensor 33 is input into an image signal processing circuit 34. The image signal processing circuit 34 converts the signal on a pixel-by-pixel basis to a pixel image signal (digital signal) having an output level corresponding to the density of the pixel and outputs the signal to a pulse width modulator circuit 35. The pulse width modulator circuit 35 forms and outputs a laser driving pulse having a width (time length) corresponding to the level for each input pixel image signal according to the image signal generated by a reference image signal generator circuit 72.

The relationship between the laser driving pulse for driving a semiconductor laser and the electrostatic latent image formed on the photosensitive drum will be described specifically with reference to FIG. 2. Reference numeral 201 indicates a laser driving pulse. Reference numeral 202 indicates a reference clock for driving a semiconductor laser 36 that is output from a clock pulse oscillator. Reference numeral 203 indicates a clock pulse count formed using the laser driving pulse 201 based on the reference clock 202. Reference numeral 204 indicates an electrostatic latent image formed on a photosensitive drum 40 according to the laser driving pulse 201. In 204, L, M and H respectively indicate electrostatic latent images of low, medium and high density pixels on the photosensitive drum 40. As shown in FIG. 2, a wide driving pulse W is formed for a pixel image signal indicating a high level of density, a narrow driving pulse S is formed for a pixel image signal of low density, and a medium-wide driving pulse I is formed for a pixel image signal of medium density.

Reverting to FIG. 1, the laser driving pulse output from the pulse width modulator circuit 35 is supplied to the semiconductor laser 36, and the semiconductor laser 36 emits light for a length of time corresponding to the pulse width. Accordingly, the semiconductor laser 36 is driven for a long time per pixel for high density pixels, and is driven for a short time per pixel for low density pixels. Specifically, for high density pixels, the photosensitive drum 40 serving as an image carrier is exposed to light, by an optical system, which will be described later, over a long range along the main scanning direction, which is the lengthwise direction of the photosensitive drum 40, per pixel. On the other hand, for low density pixels, the photosensitive drum 40 is exposed to light over a short range along the main scanning direction per pixel. In other words, an electrostatic latent image having a dot size (the size developed within one pixel) corresponding to the density of the pixels recorded is formed based on image density information of the document 31. Accordingly, as a natural consequence, the toner consumption amount for high density pixels is larger than the toner consumption amount for low density pixels.

Next, the optical system of the image forming apparatus 100 will be described. Laser beams 36*a* from the semiconductor laser 36 are incident upon a polygon mirror 37. The polygon mirror 37 is rotated at a constant angular velocity. As a result of rotation of the polygon mirror 37, the incident laser beams 36*a* are converted to deflected beams that continuously change the angle, which are then reflected. Furthermore, the laser beams 36*a* are collected by an f/θ lens group 38. The f/θ lens group 38 also performs distortion correction on the laser beams 36*a* so as to simultaneously assure the linearity of scanning time on the photosensitive drum 40. A fixed mirror 39 directs the laser beams 36*a* toward the photosensitive drum 40. Accordingly, the laser beams 36*a* are combined and scanned at a constant velocity on the photosensitive drum 40. The laser beams 36*a* are thereby scanned in the direction substantially parallel to the axis of rotation of the photosensitive drum 40 (which is the lengthwise direction of the photosensitive drum 40 and corresponds to the main scanning direction), and an electrostatic latent image is formed.

The photosensitive drum 40 having a photosensitive layer of amorphous silicon, selenium, OPC or the like on the surface thereof is a photosensitive member that rotates in the direction indicated by the arrow shown in FIG. 1. The photosensitive drum 40 is uniformly discharged by a discharger 41, and thereafter uniformly charged by a primary charger 42. After that, the photosensitive drum 40 is exposed to and scanned with the laser beams 36*a* modulated so as to correspond to the image information signal described above, and thereby an electrostatic latent image corresponding to the image signal is formed on the photosensitive drum 40. The electrostatic latent image is subjected to reversal development by a developing unit 43 that stores a dual component developer in which toner particles and carrier particles are mixed, and a visible image (toner image) is formed.

The toner and carrier used in the present embodiment will be described here. In the present embodiment, a negative toner is used in which the toner side is negatively charged and the carrier side is positively charged. The developer is a dual component developer containing an insulating non-magnetic toner and magnetic particles (carrier). The non-magnetic toner preferably has a weight average particle diameter larger than or equal to 4 μm and less than or equal to 10 μm. In the present embodiment, a toner for color copying machines having a weight average particle diameter of 7 μm is used. On the other hand, the magnetic particles (carrier) have a weight average particle diameter of 30 to 80 μm, and preferably 40 to 60 μm. In the present embodiment, magnetic particles having a weight average particle diameter of 50 μm are used. The magnetic particles have a resistance value of $10^7$ Ωcm or more, preferably $10^8$ Ωcm or more, and more preferably $10^9$ to $10^{12}$ Ωcm. Such carrier particles can be, for example, ferrite particles (with a maximum magnetic susceptibility of 60 emu/g), or ferrite particles having a thin resin coating can be effectively used. In the present embodiment, a color toner such as yellow, magenta or cyan is used, and an image is formed by dispersing the color material of the color toner using a styrene-based copolymer resin as a binder. On the other hand, in the present embodiment, a black toner is also a dual component developer, but carbon black is used as the color material in order to produce pure black.

The reversal development as used herein refers to a development method in which a developing material (toner) charged with the same polarity as the latent image is attached to the region of the photosensitive drum 40 exposed with the laser light and is visualized. The toner image is extended between two rollers 45 and 46, and is transferred, by the action of a transfer charger 49, onto a transfer material 48 held on a transfer material carrying belt 47 that is endlessly driven in the direction indicated by the arrow in FIG. 1. The transfer material 48 on which the toner image has been transferred is separated from the transfer material carrying belt 47, conveyed to a fixing unit (not shown), and fixed. After that, residual toner 28 remaining on the photosensitive drum 40 after image transfer is removed by a cleaner 50.

Variation of Image Forming Apparatus

A main configuration of an image forming apparatus 300 according to a variation of the present embodiment will be described next with reference to FIG. 3. Hereinafter, the same components as those of the image forming apparatus 100 will be given the same reference numerals, and descriptions thereof are omitted. In the image forming apparatus 300, for example, image forming units for, for example, cyan, magenta, yellow and black are arranged in order on an intermediate transfer belt 52 along the moving direction thereof. On the photosensitive drum 40 of each image forming station is formed an electrostatic latent image of the corresponding color obtained through color separation of the document image, which is then developed by the developing unit 43 storing the corresponding color toner, and all of the colors are sequentially transferred on the intermediate transfer belt 52. After that, all of the colors are collectively transferred on the transfer material 48 by a secondary transfer roller 53, and thereby a full color image is obtained.

The present invention is also applicable to the image forming apparatus 300 described above. The image forming apparatus of the present invention may have, in addition to the function of copying documents, a printer function and a facsimile function that form an image transmitted from a personal computer connected to the image forming apparatus via a network cable on a transfer material such as paper. In other words, the image forming apparatus of the present invention is also capable of forming images based on image density information of non-paper documents.

Development Process

Figure 4:
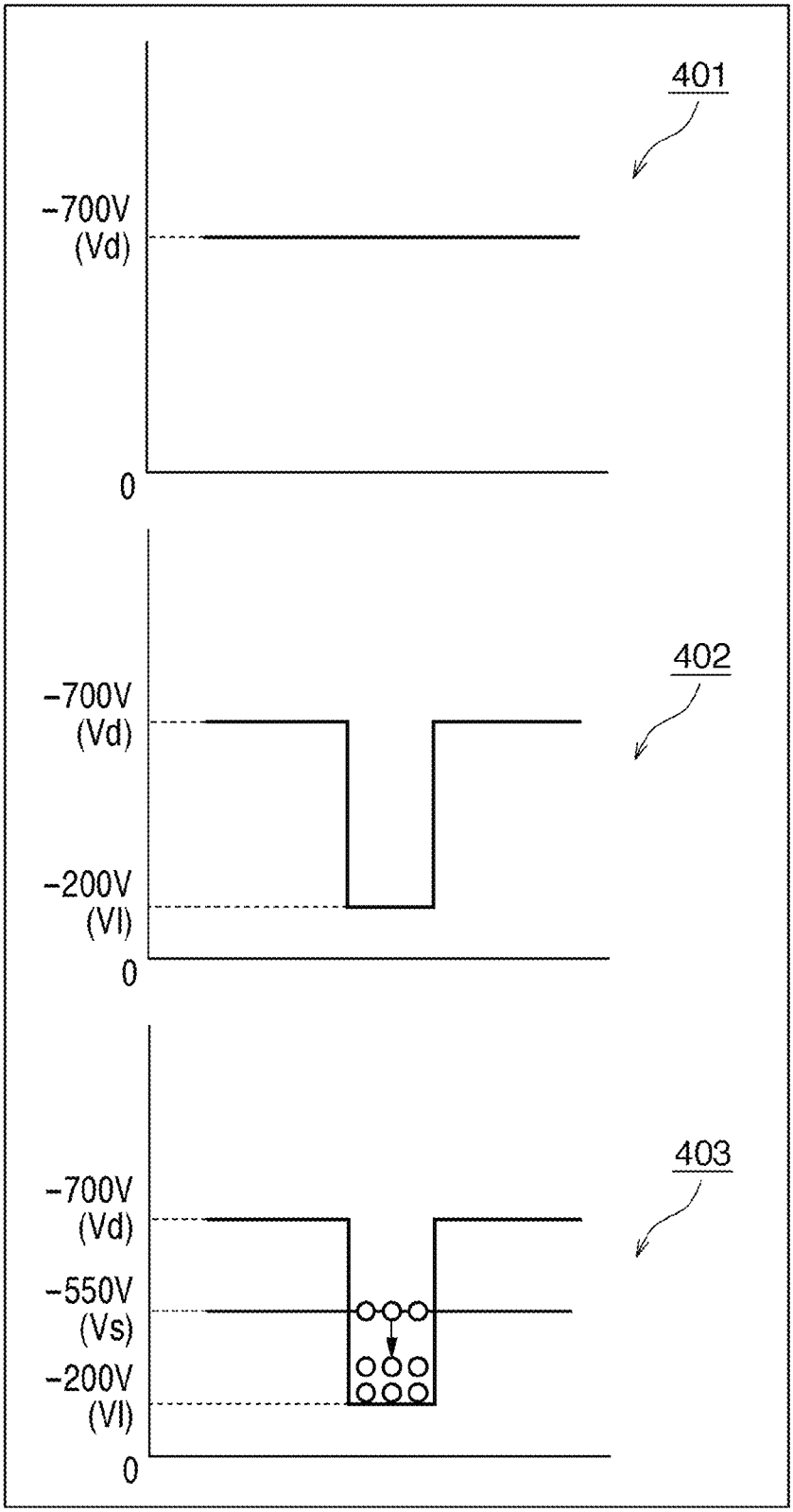
FIG. 4 is a diagram illustrating a development process according to the first embodiment.

A development process according to the present embodiment will be described next with reference to FIG. 4. The photosensitive drum 40 is uniformly charged to −700V (Vd) as indicated by 401 by the primary charger 42, and an electrostatic latent image of −200V (Vl) as indicated by 402 is formed on the portion irradiated with the laser beams 36*a*. As used herein, Vd represents the potential of the photosensitive drum 40 charged by the primary charger 42, and Vl represents the potential of the photosensitive drum 40 attenuated by irradiation of the laser beams 36*a*.

Then, with application of a direct current voltage of −550V (Vs) onto the developing sleeve of the developing unit 43, the electrostatic latent image formed on the photosensitive drum 40 is subjected to reversal development by negatively charged toner, and a toner image as indicated by 403 is formed. Contrast potential (v) refers to the difference between the value read by a potential sensor 51 shown in FIG. 1 that functions as a contrast potential detecting means and the developing bias Vs. A positive charge is imparted to the underside of the transfer material 48 by the transfer charger 49, the toner image is transferred onto the transfer material 48, and thereby a desired image can be obtained on the transfer material 48. The transfer material 48 described here corresponds to the intermediate transfer belt 52 in the image forming apparatus 300.

The image forming apparatuses 100 and 300 of the present embodiment are provided with a magnetic sensor derived from magnetic characteristics that change with the developer bulk density. As the so-called magnetic sensor, an inductance detection sensor 7 is installed on the side wall of a second chamber (stir chamber) R2 in the developing unit 43. In the present embodiment, the inductance detection sensor 7 has been installed on the side wall of the second chamber (stir chamber) R2 in the developing unit 43, but the installation location may be a different location as long as the developer can flow stably without stopping and the location is not affected by changes in developer surface. The inductance detection sensor 7 used as a developer magnetic sensor in the present embodiment will be described now.

Figure 12:
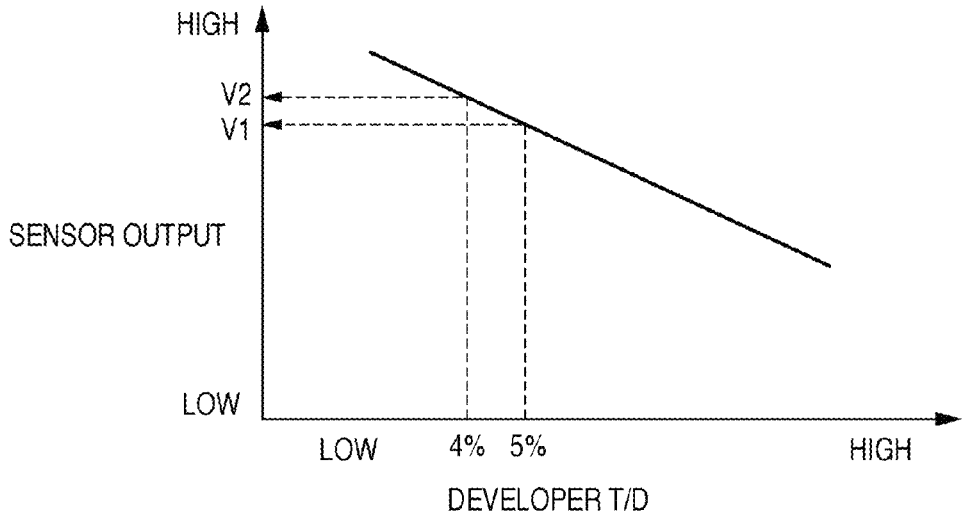
FIG. 12 is a diagram showing the relationship between toner density and the output value from an inductance detection sensor.

The inductance detection sensor 7 detects a change in the bulk density of the developer as a change in apparent magnetic permeability. In the present embodiment, the signal detected by the inductance detection sensor 7 for the bulk density of the initial developer in a room temperature chamber in which the air contains 10.5 g of water at 23 degrees and 60% is set as a reference value for controlling the bulk density of the developer. If, for example, it is determined that the detected signal is higher than the reference value and the apparent magnetic permeability of the developer is large, it means that the carrier particles account for a large proportion in the developer within a given volume, or in other words, the bulk density is high. Conversely, if it is determined that the detected signal is lower than the reference value and the apparent magnetic permeability is small, it means that the carrier accounts for a small proportion in the developer within a given volume, or in other words, the bulk density is low. FIG. 12 shows the relationship between toner density and the output value of the inductance detection sensor 7. It can be seen that, for example, if the toner-to-carrier ratio (T/D ratio) is varied from 5%, which is the reference value, to 4%, the output of the inductance detection sensor 7 varies from V1 to V2.

Figure 5:
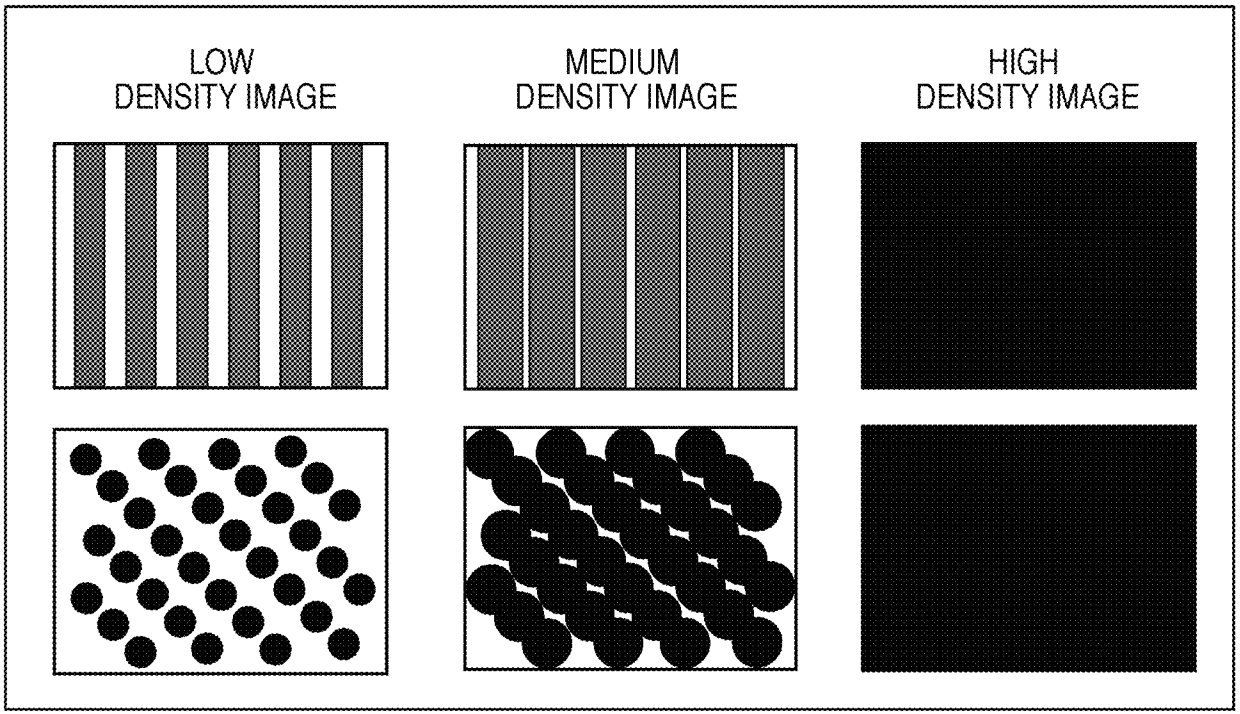
FIG. 5 is a diagram illustrating electrostatic latent images formed on the photosensitive drum according to the first embodiment.
Figure 6:
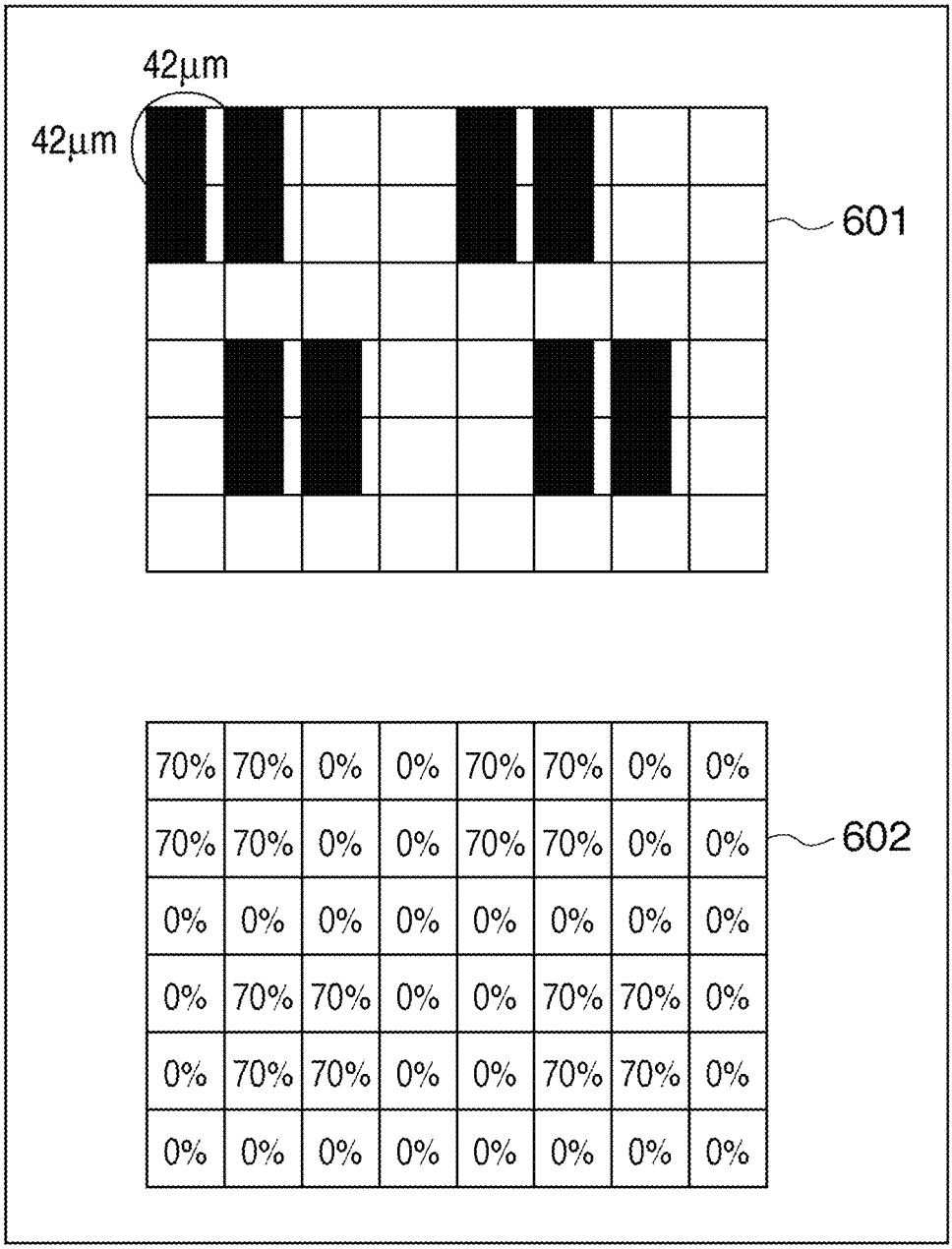
FIG. 6 is a diagram showing an example of 256 gray scale reproduction (0 to 255 levels) according to the first embodiment.

Electrostatic Latent Image: FIGS. 5 and 6

The electrostatic latent images according to the present embodiment will be described next with reference to FIGS. 5 and 6. FIG. 5 is a diagram illustrating the electrostatic latent images formed on the photosensitive drum according to the present embodiment. In order to represent each image density (low density image, medium density image, high density image), the period of the laser driving pulse (the number of laser emissions per inch, hereinafter expressed in the unit dpi) and the spot size of the laser beams 36*a* are changed. Usually, for low density images, electrostatic latent images are formed from isolated dots and lines as shown in FIG. 5. Larger isolated dots are formed as the density increases toward medium density, and therefore the dots come into contact with adjacent dots, and the lines are also represented as thick lines. Furthermore, in high density images, isolated dots and lines cannot be recognized.

FIG. 6 shows, as an example, details when forming an 85 gray-level latent image of the 256 (0 to 255 levels) gray scale reproduction in the present embodiment. The image forming apparatuses 100 and 300 of the present embodiment are assumed to be capable of forming images at a resolution of 600 dpi (main scanning direction)×600 dpi (sub-scanning direction). Minimum squares 601 and 602 each represent unit pixels (one pixel of 600 dpi in this example) having a size of 42 μm×42 μm. In each unit pixel, the semiconductor laser 36 can emit light for 0% to 100% of the time, but turning the semiconductor laser 36 on and off cannot be repeated more than twice. In other words, it is not possible to, for example, turn on the semiconductor laser 36 for 30% of the time, thereafter turn it off for 50% of the time, and turn it on again for the remaining 20% of the time for a pixel. As used herein, unit pixel refers to a minimum area in which the laser can be turned on only once (in this example, one pixel of 600 dpi with a size of 42 μm×42 μm). The semiconductor laser 36 used is assumed to have a spot size of 43 μm×50 μm.

In 602, the percentage of time during which the semiconductor laser 36 is allowed to emit light per unit pixel is shown. The laser beams 36*a* from the semiconductor laser 36 scan in the right direction in the diagram (the lengthwise direction of the photosensitive drum 40), and if the laser beams have been constantly emitted (entirely emitted) throughout scanning of a given pixel, 100% is written. In 601, the light emission time is shown as a black shaded area in order to visualize it. In other words, an 85 gray-level latent image is formed based on data as described above. At a 0 level, all of the minimum squares indicate 0%, and at a 255 level, all of the minimum squares indicate 100%.

Tentative Determination of Contrast Potential

Hereinafter, the tentative determination of the contrast potential will be described. In the present embodiment, as will be described below, first, a patch image having a plurality of density levels is formed for a predetermined toner charge amount, and the contrast potential at that time and the density of the formed patch image are measured. Herein, this process is collectively called "the tentative determination of the contrast potential".

Figure 7:
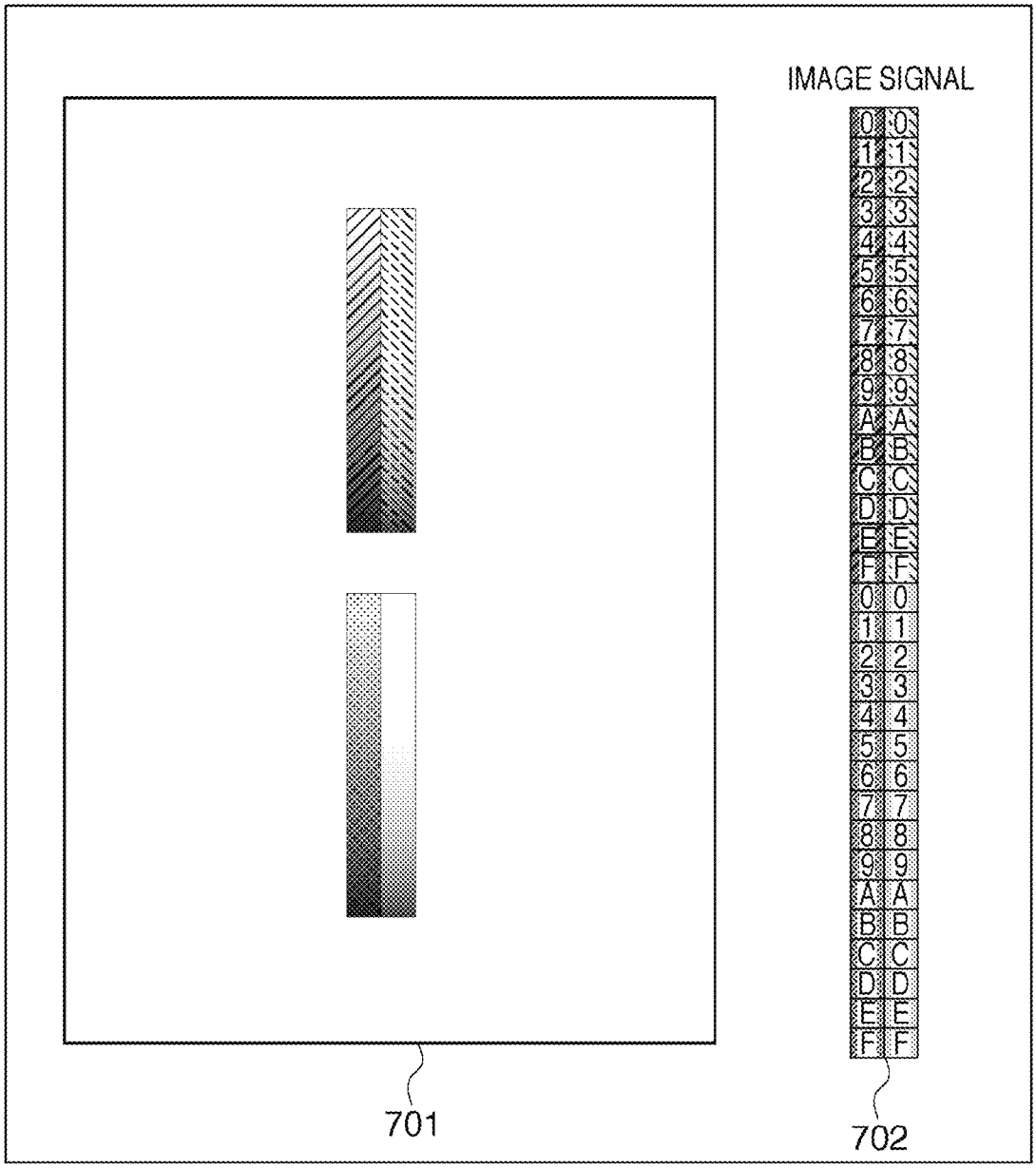
FIG. 7 is a diagram showing an image when performing control so as to determine the contrast potential at which a high density image is obtained.

FIG. 7 is a diagram showing an image when performing control so as to determine a contrast potential at which a high density image is obtained. 701 indicates a conceptual diagram, and 702 indicates image signal levels. The image signal is a laser signal level per pixel and indicates a laser emitting width (the duration of light emission). The maximum emitting width is set to F, and the other levels are equally assigned such that the amount of light becomes linear. Here, one pixel is 600 dpi. In the present embodiment, even at the F level, laser illumination need not be continued for all of the time for one pixel, and laser illumination may be continued for 70% of the time. This is derived taking a turn-off delay into consideration, but the value is not limited thereto.

A procedure for determining the contrast potential will be described next with reference to FIGS. 8A and 8B. A CPU 101 shown in FIG. 1 performs overall control of the process described below. In the image forming apparatus 300 as well, a CPU (not shown) performs control in a similar manner. This flowchart starts by a user instruction when the user wants to adjust the image density. Specifically, this flowchart starts by the CPU 101 receiving an instruction to adjust the density from the user via a touch panel (not shown) attached to the image forming apparatus 100.

In S1, the CPU 101 predicts a toner charge amount, which will be described later, from various engine conditions. Here, the toner charge amount obtained at this time is defined as QMp. Hereinafter, this control is referred to as "control A". Subsequently, in S2, the CPU 101 sets, as settings for adjustment, the primary charging bias, the developing bias and the laser power to levels higher than those for normal image formation.

Next, the CPU 101 sets the image signal to a 0 level at 600 dpi in S3, forms an electrostatic latent image in S4, and measures the potential of the photosensitive drum 40 using the potential sensor 51 in S5. Subsequently, the CPU 101 sets the image signal to a 1 level in S6, forms an electrostatic latent image in S7, and measures the potential of the photosensitive drum 40 using the potential sensor 51 in S8. As described above, the process spanning from S3 to S5 is repeated for each level of the image signal, and through the process spanning from S9 to S11, electrostatic latent images at 0 to F levels are sequentially formed, and each potential is read by the potential sensor 51. The reason that the primary charging bias, the developing bias and the laser power are set to levels higher than those for normal image formation is to securely obtain a target density (1.6 in this example) from the images obtained through this control. Specifically, in the present embodiment, the contrast potential is 100 V higher than usual, and the laser power is set to Max (maximum value).

Figure 9:
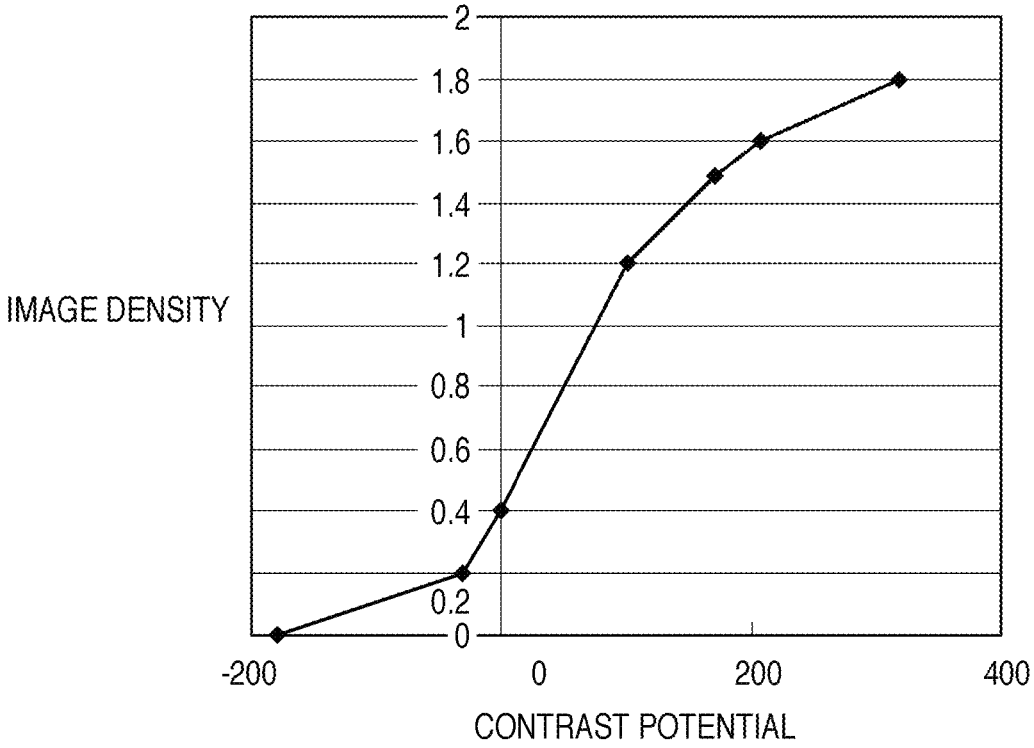
FIG. 9 is a diagram showing the relationship between contrast potential (V) and image density according to the first embodiment.

After that, the CPU 101 causes the image shown in FIG. 7 to be formed on the transfer material 48 and output in S12, and thereafter reads an image on the document 31 using the image sensor 33, such as a CCD, via the lens 32 in S13. In S14, the CPU 101 detects the image density from the read results. Accordingly, the process spanning from S13 to S14 is an example of a process of a density detecting means. The relationship between contrast potential (V) and image density is shown in FIG. 9. The CPU 101 calculates the relationship between the potential of the photosensitive drum 40 and the density in S15, and calculates a contrast potential that is the target density in S16.

By measuring the potential of an electrostatic latent image with the potential sensor 51, the contrast potential can be obtained, and the density can be obtained by reading the above-described image with a scanner or the like and converting it to a density value. From the relationship between density and contrast potential, it is possible to determine a contrast potential at which a desired density can be obtained. The method for setting the primary charging bias and the developing bias in order to obtain a contrast potential can be performed by a known method.

Figure 8A:
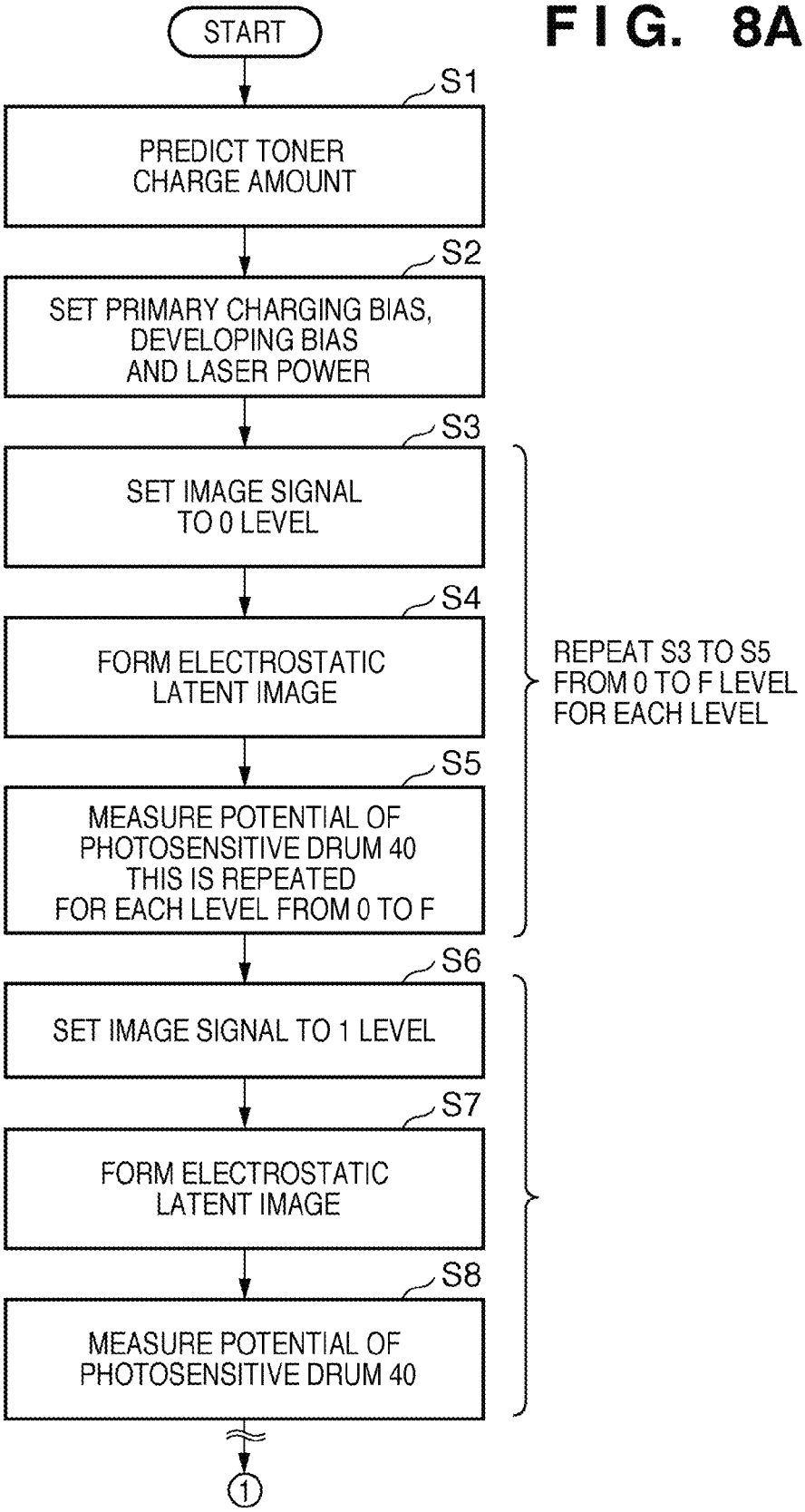
FIGS. 8A and 8B are flowcharts illustrating the procedure for deriving the contrast potential according to the first embodiment.
Figure 8B:
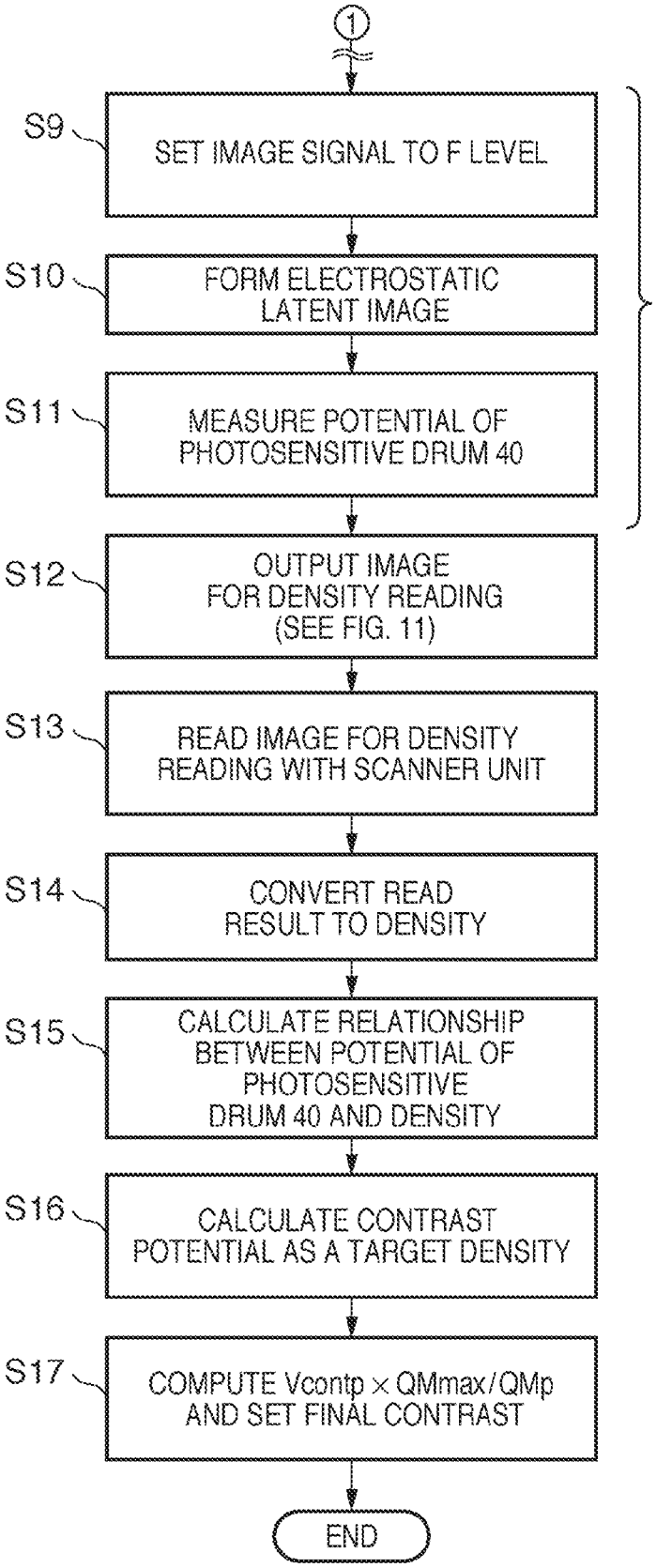

The contrast potential (Vcontp) obtained here is not always optimal because the contrast potential obtained through the flowchart of FIGS. 8A and 8B is the contrast potential established for a predetermined toner charge amount. The toner charge amount is another important factor for stabilizing the image quality. Electrophotography and electrostatic recording methods create images using electrostatic forces, and for this reason, when the toner charge amount varies, the image density varies accordingly. Factors that cause the toner charge amount to vary include the temperature and humidity of the installation location of the image forming apparatus, the time period when not in use, the toner consumption amount and the toner supply amount. In other words, when the toner charge amount varies after execution of the flowchart of FIGS. 8A and 8B, the image density varies accordingly. As a result, the required contrast potential may not be appropriate.

The contrast potential set in the flowchart of FIGS. 8A and 8B are defined as Vcontp. The above-described process for determining the contrast potential from the relationship between density and contrast potential is merely an example, and the present invention is not limited thereto. Three examples of methods that are simpler but less accurate than the above-described method will be given below. The first method is a method in which a solid density and a contrast potential are determined by predicting, using a single patch rather than a plurality of patches, a density around the patch density and a contrast potential. The second method is a method in which a contrast potential is predicted by predicting a solid density and a contrast potential required at this time from the halftone patch density and a contrast potential. The third method is a method in which an unfixed toner patch on the image carrier, rather than paper, is read using an optical sensor and the read result is defined as the density.

In the present embodiment, the contrast potential obtained through the control A (the flowchart of FIGS. 8A and 8B) is not set as the final contrast potential. In other words, in the present embodiment, even if the obtained patch densities are the same, different contrast potentials are set according to the toner charge amount at that time. The contrast potential determined through execution of the control A after paper insertion for a job having a large toner consumption amount and the contrast potential determined through execution of the control A after paper insertion for a job having a small toner consumption amount are different. In the present embodiment, final contrast potential (Vcontb) finally determined is set according to saturation toner charge amount QMmax predicted from the engine conditions, and the density is corrected. How to determine the toner charge amount predicted from the engine conditions will be described later.

Deriving Saturation Toner Charge Amount

Figure 10:
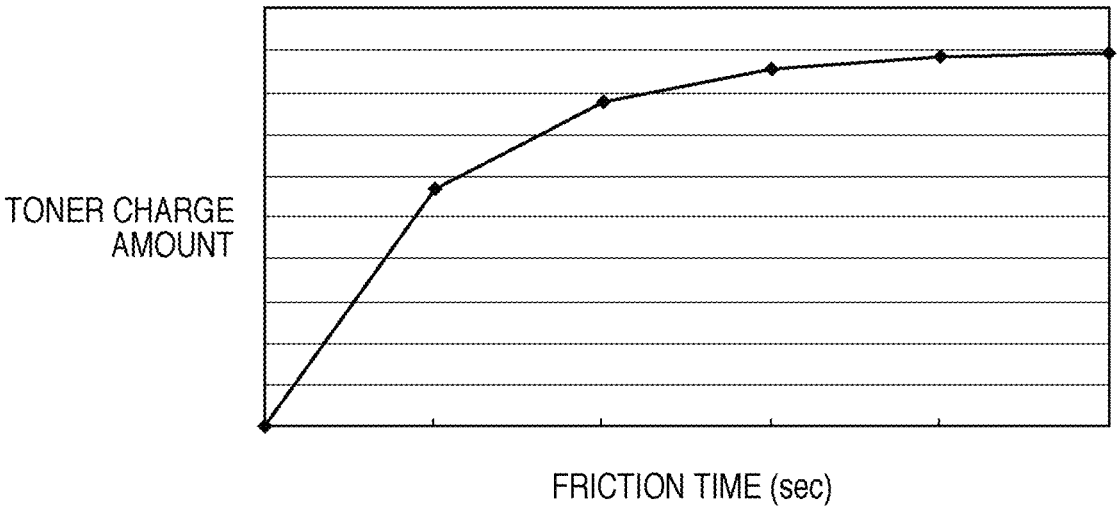
FIG. 10 is a diagram showing an example of change in the toner charge amount due to stirring.
Figure 11:
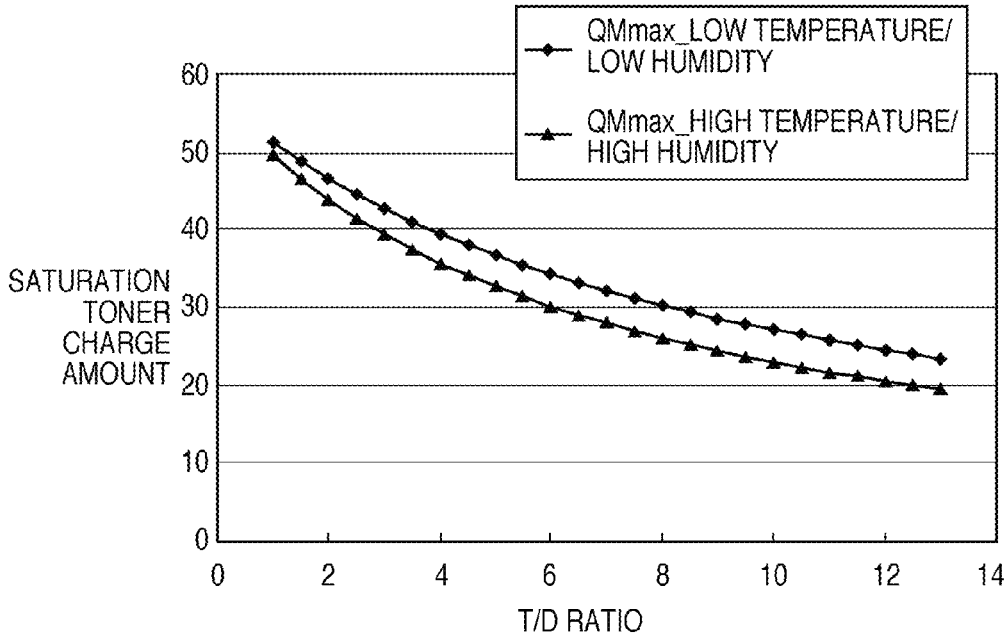
FIG. 11 is a diagram showing the relationship between T/D ratio and saturation toner charge amount.

How to determine the saturation toner charge amount will be described next with reference to FIGS. 10 and 11. The process for calculating the saturation toner charge amount described below is an example of a process of a first calculation means, specifically, the process is implemented by control by the CPU 101. As is well known, in dual component developers, the toner charge amount is affected by the magnitude of force toward the developer latent image, and is a very important factor for stabilizing the image quality. The toner charge amount is affected primarily by the toner-to-carrier ratio (T/D ratio) within the developing unit 43, the temperature and humidity of the surroundings of the developing unit 43 (operation environment) and the degradation of the developer due to the number of times the developer is stirred.

An example of change in the toner charge amount due to stirring will be described first with reference to FIG. 10. The toner not in use for a long period of time is tribocharged by being stirred within the developing unit 43 and rubbed with the carrier. As shown in FIG. 10, the toner charge amount converges to a constant value as time passes. In the present embodiment, the convergence value is defined as the saturation toner charge amount. Like the toner charge amount, the saturation toner charge amount is also affected primarily by the toner-to-carrier ratio (T/D ratio) within the developing unit 43, the temperature and humidity of the surroundings of the developing unit 43, and the degradation of the developer due to the number of times of stirring the developer. With the toner and carrier used in the present embodiment, the toner charge amount is low on the high temperature/high humidity side where the operation environment, that is, the temperature and humidity of the surroundings of the developing unit 43 is high. Conversely, on the low temperature/low humidity side, the toner charge amount is high. Also, the toner charge amount becomes lower as the toner-to-carrier ratio (T/D ratio) within the developing unit 43 becomes higher, and the toner charge amount becomes higher as the toner-to-carrier ratio (T/D ratio) within the developing unit 43 becomes lower.

In the present embodiment, a temperature/humidity sensor and the inductance detection sensor 7 installed in the image forming apparatus 100 or 300 read the temperature and humidity (relative humidity RH) of the surroundings of the developing unit 43 and the toner-to-carrier ratio (T/D ratio) within the developing unit 43. Then, using the readings from these sensors, the saturation toner charge amount QMmax is determined from the following Equation 1.

$$QM\text{max}=QM\text{top}/(1+(ARH+ATD)\times TD), \qquad \text{Equation 1}$$

where ATD represents the TD dependent coefficient according to the relative humidity, and TD represents the T/D ratio determined from the inductance detection sensor 7. As an example, the relationship between T/D ratio and saturation toner charge amount in a low temperature/low humidity state and a high temperature/high humidity state is shown in FIG. 11. ARH is a variable indicating the operation environment determined from the temperature/humidity sensor. In the present embodiment, the value varies from 0.0008 to 0.0392 according to the relative humidity. ATD is the TD dependent constant, and is set to 0.11 in the present embodiment. The smaller the ARH value, the smaller the decrease in QMmax that occurs with increasing T/D ratio. FIG. 11 illustrates that the carrier is more likely to charge the toner as the ARH value becomes smaller, and is less likely as the ARH value becomes larger. QMtop is set to 57 μC/g on the assumption that TD=0. As shown in FIG. 11, the saturation toner charge amount varies according to the T/D ratio.

Deriving Current Toner Charge Amount

Figure 13:
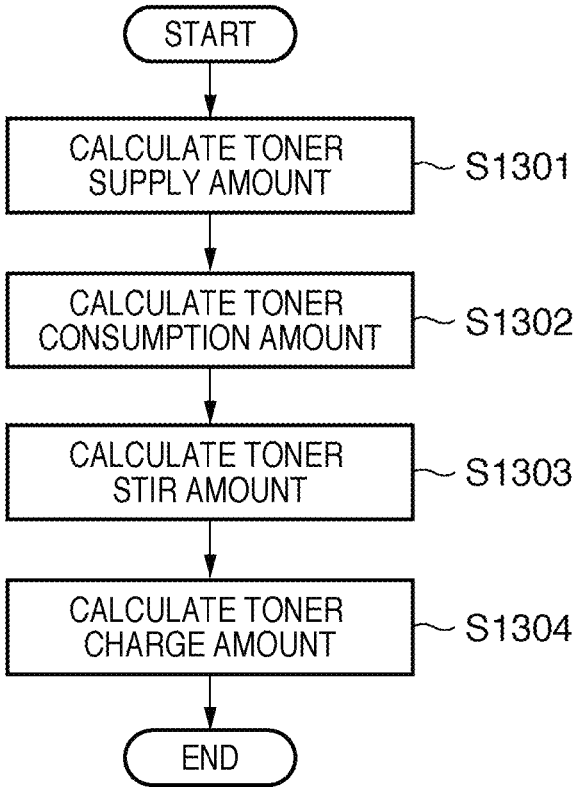
FIG. 13 is a flowchart illustrating the procedure for computing the toner charge amount according to the first embodiment.

How to determine a current toner charge amount will be described next with reference to FIGS. 13 and 14. The process for calculating the current toner charge amount, which will be described below, is an example of a process of a second calculation means, specifically, the process is implemented by control by the CPU 101. First, a configuration for deriving the current toner charge amount will be described with reference to FIG. 14. The CPU 101 functions as a toner consumption amount detecting unit that detects the toner consumption amount used, a stir detecting unit that detects the amount of the developer stirred, a toner supply amount detecting unit that detects the amount of toner supplied to the developer, and a non-stir detecting unit that detects the state in which the developer is not stirred. The CPU 101 also computes the toner charge amount in the developer from information obtained from each detecting unit.

Figure 14:
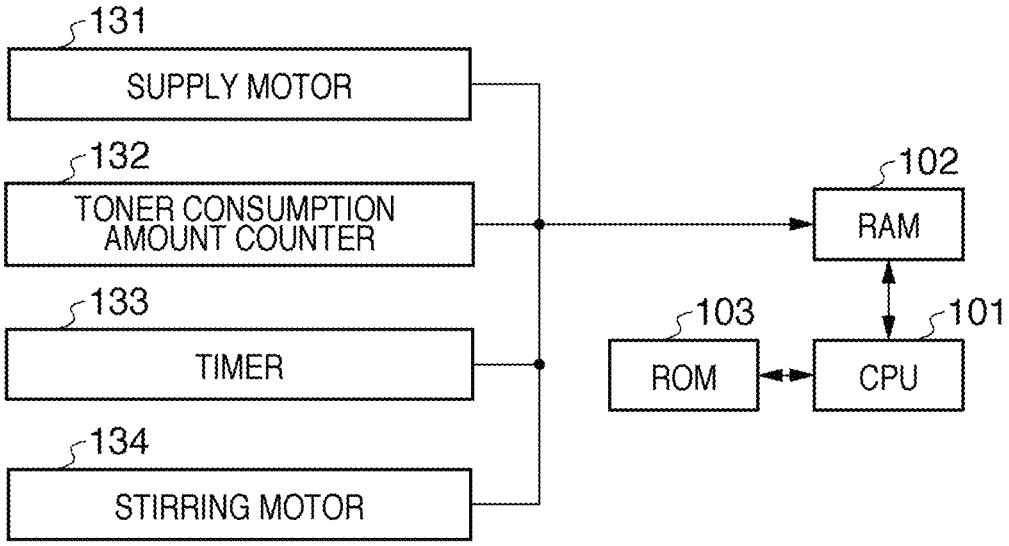
FIG. 14 is a diagram showing an example of a configuration that computes the toner charge amount according to the first embodiment.

As shown in FIG. 14, the CPU 101 receives an input of the output from a toner consumption amount counter 132 for detecting the toner consumption amount that is used and an input of an ON/OFF signal of a stirring motor 134 that detects the stir amount of the developer. Furthermore, the CPU 101 also receives an input of an ON/OFF signal of a supply motor 131 that detects the toner supply amount to the developer and an input of each signal of a timer that detects the non-stirred state. The CPU 101 is connected to a work buffer RAM 102 for computing the current toner charge amount by using each input signal and a ROM 103 containing a table needed for computation.

From the following Equation 2, toner charge amount QMhopper immediately after toner is supplied from a hopper (a toner supply device for supplying toner to the developing unit 43) is calculated.

$$QM\text{hopper}=a\times QM\text{max}, \qquad \text{Equation 2}$$

where a represents the amount of toner supplied from the hopper.

Next, total toner amount Ttotal in the developing unit 43 is calculated. Generally, the total toner amount can be calculated easily from information such as the capacity of the developing unit 43 and the toner density acquired from the inductance detection sensor 7. The saturation toner charge amount QMmax, the toner charge amount QMhopper immediately after toner supply, and the total toner amount Ttotal obtained through the above-described processes are used in a density gray scale correction process, which will be described later.

A procedure for computing the current toner charge amount of the image forming apparatus 100 or 300 will be described next with reference to FIG. 13. The CPU 101 performs overall control of the process described below. It is assumed here that the density gray scale correction is performed for each output page, and the processing procedure described below is also performed each time output is performed.

First, in S1301, when calculating the toner charge amount for the nth page, the CPU 101 calculates the amount of toner supplied during the time between the time when the toner charge amount for the (n−1)th page (previous time) was calculated and the time when the current correction process is performed. As used herein, the toner supply amount is determined by the CPU 101 with some method, and there is no limitation on the method. A method for determining the toner supply amount is proposed by, for example, Japanese Patent Laid-Open No. 05-323791.

In S1302, the CPU 101 calculates the toner amount consumed during the time between the time when the toner charge amount for the (n−1)th page was calculated and the time when the current correction process is performed. It is assumed here that the pixel values (video count values) of the input image data of the (n−1)th page are integrated so as to predict the toner consumption amount. The toner consumed for purposes other than forming images, such as toner used to adjust the toner density within the developing unit 43, is also regarded as consumed. In other words, the amount of toner removed from the developing unit 43 is calculated. The toner consumption amount is output from the toner consumption amount counter 132 to the CPU 101.

In S1303, the CPU 101 calculates the amount of toner stirred within the developing unit 43 during the time between the time when the toner charge amount for the (n−1)th page was calculated and the time when the toner charge amount for the nth page is calculated. Here, a screw within the developing unit 43 is assumed to be rotated at a constant speed, and the rotation time of the screw is defined as the toner stir amount. The rotation time of the screw is calculated using the ON/OFF signal from the stirring motor 134.

In S1304, the CPU 101 calculates the toner charge amount based on the toner supply amount Tsup, the toner consumption amount Tused, and the toner stir amount. The CPU 101 calculates the toner charge amount QMstir for the nth page in the case where the toner was not consumed or supplied, from the toner charge amount QM calculated for the (n−1)th page, the saturation toner charge amount QMmax and the toner stir amount that have been recorded. Here, for the amount of increase, a table is used in which the relationship between the toner charge amount QM, the saturation toner charge amount QMmax, the toner stir amount Tstir, and the toner charge amount QMstir after stirring that have been acquired in advance is written. Next, current toner charge amount QMpresent for density gray scale correction of the nth page is calculated using Equation 3 from the toner charge amount QMstir after stirring, the toner supply amount Tsup, the toner consumption amount Tused, the toner charge amount QMhopper immediately after toner supply, and the total toner amount Ttotal.

$$QM\text{present}=(QM\text{stir}\times(T\text{total}-T\text{used})+QM\text{hopper}\times T\text{sup})/(T\text{total}-T\text{used}+T\text{sup})$$

The current toner charge amount QMpresent can be determined in the manner described above.

As described thus far, the image forming apparatus of the present embodiment measures, in advance, a contrast potential of the electrostatic latent image and a density of the toner image at the contrast potential for a predetermined toner charge amount. Furthermore, when forming images, the image forming apparatus adjusts the relationship between the contrast potential and density measured in advance based on the current toner charge amount and the saturation toner charge amount, and forms an image. The image forming apparatus of the present embodiment can thereby perform density correction taking a change in the toner charge amount into consideration.

Determination of Contrast Potential

The contrast potential Vcontb finally determined will be described next. The contrast potential Vcontb finally determined is the contrast potential corresponding to a change in the toner charge amount due to paper insertion, so that a target Vcont corresponding to a change in density can be obtained. In order to obtain a desired density even when the user starts paper insertion and thereby the toner charge amount changes, the target Vcont is set using the following Equation 4.

$$V\text{cont}b=V\text{cont}p\times QM\text{max}/QMp,$$

where QMp represents the current toner charge amount. The target Vcont is thereby set such that a desired density can be obtained at the time when the saturation toner charge amount is assumed. It is also possible to set the contrast potential to Vcontb, which is the Vcont finally determined, determine the primary charging bias and the developing bias by a known method, thereafter form a gray scale patch, and correct a lookup table or the like with respect to gray scale. By setting the contrast potential based on the saturation toner charge amount in the manner as described above, the need to adjust the contrast settings according to the change in the toner charge amount due to paper insertion can be eliminated.

As described above, with the image forming apparatus of the present embodiment, density variations can be reduced to about half by performing laser power control so as to obtain the target Vcont according to the toner charge amount. Also, the contrast potential is set based on the saturation toner charge amount, and thereby the need to adjust the contrast settings according to the change in the toner charge amount due to paper insertion can be eliminated, and the frequency of adjustment by the user can be reduced.

Second Embodiment

Figure 15:
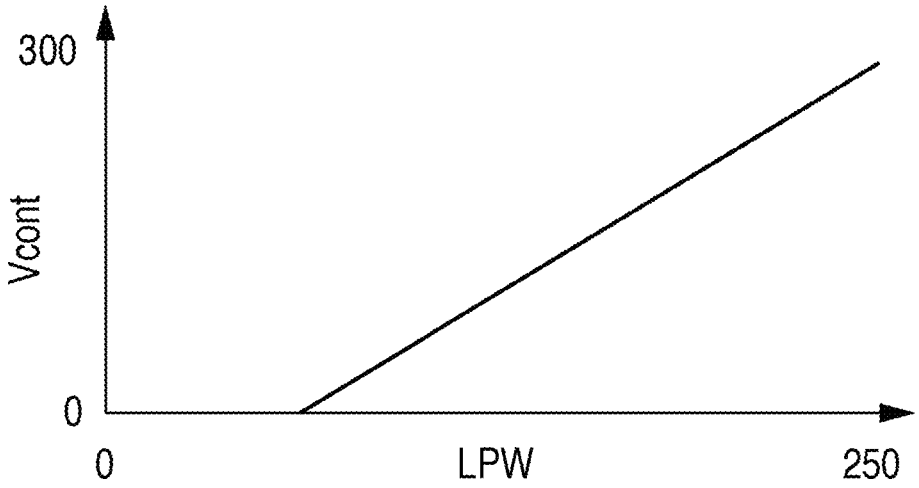
FIG. 15 is a diagram showing the relationship between contrast potential and laser power according to a second embodiment.

A second embodiment will be described hereinafter with reference to FIG. 15. A feature of the present embodiment is that density correction is performed by setting the contrast potential to Vcontb, which is the target Vcont, and performing laser power control based on QMpresent, which is the toner charge amount predicted so as to follow Vcontp at which the target density is developed. Note that descriptions of the same components and techniques as those of the first embodiment are omitted hereinafter.

The contrast potential Vcont set at printing is determined based on the following Equation 5.

$$Vcont = Vcontb \times QMp / QMmax \quad \text{Equation 5:}$$

The relationship between contrast potential and laser power is determined in advance by the control A. FIG. 15 shows the relationship between contrast potential and laser power. The laser power is adjusted to Vcontp, which is Vcont determined through the control A. In other words, the laser power is adjusted such that Vcontb/QMmax becomes constant, and set to a desired Vcont.

Here, a procedure for density correction according to the present embodiment will be described. First, the CPU 101 computes Vcontb×QMp=230×30=6900 at the time when the control A has been performed. The laser power is set to 200 at this time. After that, as a result of paper insertion by the user, the toner charge amount becomes 25. Next, the CPU 101 computes 6900/25=276. Furthermore, the CPU 101 changes the laser power from 200 to 230 so that Vcont becomes 276.

Execution Results

Figure 16:
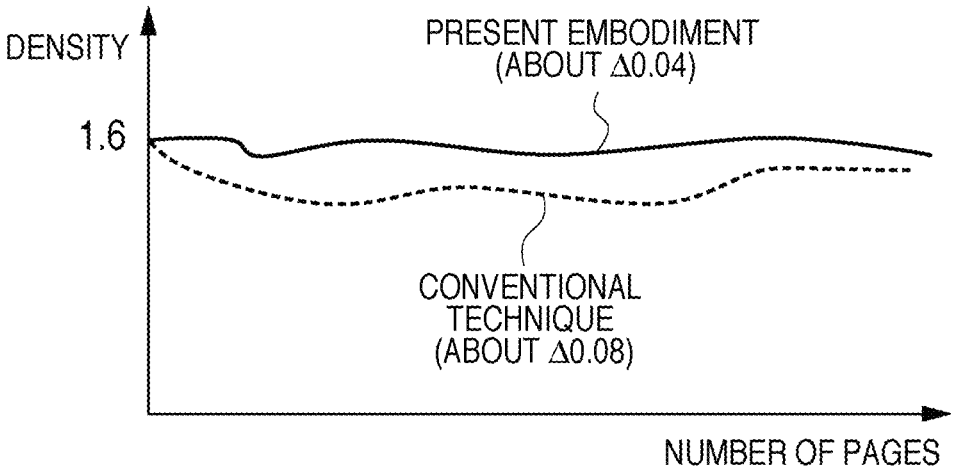
FIG. 16 is a diagram showing variations in image density when a density correction according to the present invention has been applied and when a conventional density correction has been applied.

FIG. 16 shows density variations when the density correction according to the present invention has been carried out and density variations when a conventional density correction has been carried out. In FIG. 16, the number of images formed is shown on the horizontal axis, and density is shown on the vertical axis. These results are obtained when an image has been formed on a plurality of recording paper sheets with the same density. As shown in FIG. 16, a density variation when a conventional density correction has been carried out is 0.08, whereas a density variation when the density correction of the present embodiment has been carried out is 0.04. In other words, it can be seen that density variation from the control A is suppressed with the density correction according to the present embodiment.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-090917 filed on Apr. 9, 2010, which is hereby incorporated by reference herein in its entirety.

The invention claimed is:

1. An image forming apparatus comprising a charging means for charging an image carrier, an exposure means for exposing the charged image carrier to light to form an electrostatic latent image, and a development means for developing the electrostatic latent image using toner, the image forming apparatus further comprising:

a detecting means for detecting a contrast potential of the electrostatic latent image and a density of the toner image developed by the development means; and a determining means for determining a final contrast potential for image formation, using a relationship between the contrast potential of the electrostatic latent image and the density of the toner image detected by the detecting means, and a ratio between a saturation toner charge amount that is an amount of charge of toner converged to a given value and a current toner charge amount that is a current amount of charge of toner for image formation.

2. The image forming apparatus according to claim 1, wherein the detecting means comprises:

a forming means for forming a patch image having a plurality of density levels at a predetermined toner charge amount;

a contrast potential detecting means for detecting a contrast potential of each electrostatic latent image when forming the patch image having respective density levels formed by the forming means; and a density detecting means for detecting a density of the patch image having respective density levels formed by the forming means.

3. The image forming apparatus according to claim 1, further comprising a first calculation means for calculating the saturation toner charge amount according to a current operation environment, from a toner-to-carrier ratio stored in the development means and a relative humidity that is a variable of the operation environment of the image forming apparatus.

4. The image forming apparatus according to claim 1, further comprising a second calculation means for calculating the current toner charge amount based on a toner supply amount, a toner consumption amount and a toner stir amount.

5. The image forming apparatus according to claim 1, wherein the determining means, when forming a toner image of a predetermined density, determines the final contrast potential using Vcontb=Vcontp×QMmax/QMp, where Vcontp is the contrast potential detected by the detecting means and corresponding to the predetermined density, QMmax is the saturation toner charge amount, QMp is the current toner charge amount, and Vcontb is the final contrast potential.

6. A method for controlling an image forming apparatus including a charging means for charging an image carrier, an exposure means for exposing the charged image carrier to light to form an electrostatic latent image, and a development means for developing the electrostatic latent image using toner, the method comprising:

detecting, by a detecting means, a contrast potential of the electrostatic latent image and a density of the toner image developed by the development means; and determining, by a determining means, a final contrast potential for image formation, using a relationship between the contrast potential of the electrostatic latent image and the density of the toner image detected in the detecting step, and a ratio between a saturation toner charge amount that is an amount of charge of toner converged to a given value and a current toner charge amount that is a current amount of charge of toner for image formation.

* * * * *